US010462567B2

(12) United States Patent
Amman et al.

(10) Patent No.: US 10,462,567 B2
(45) Date of Patent: Oct. 29, 2019

(54) RESPONDING TO HVAC-INDUCED VEHICLE MICROPHONE BUFFETING

(71) Applicant: Ford Global Technologies, LLC, Dearborn, MI (US)

(72) Inventors: Scott Andrew Amman, Milford, MI (US); Alan Norton, West Bloomfield, MI (US); Joshua Wheeler, Trenton, MI (US); Gintaras Vincent Puskorius, Novi, MI (US); Ranjani Rangarajan, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/290,727

(22) Filed: Oct. 11, 2016

(65) Prior Publication Data

US 2018/0103318 A1 Apr. 12, 2018

(51) Int. Cl.

| | |
|---|---|
| ***H04R 29/00*** | (2006.01) |
| ***H04R 3/02*** | (2006.01) |
| ***H04R 3/04*** | (2006.01) |
| ***H04R 3/00*** | (2006.01) |

(52) U.S. Cl.

CPC ..... *H04R 3/02* (2013.01); *H04R 3/00* (2013.01); *H04R 3/04* (2013.01); *H04R 29/004* (2013.01); *H04R 2410/07* (2013.01); *H04R 2499/11* (2013.01); *H04R 2499/13* (2013.01)

(58) Field of Classification Search

CPC ..... H04R 2400/01; G10K 2210/1282; G10K 2210/12822; G10K 2210/3045; G10L 17/20; G10L 2021/02161

See application file for complete search history.

(56) References Cited

U.S. PATENT DOCUMENTS

| | | | |
|---|---|---|---|
| 4,655,673 | A | 4/1987 | Hawkes |
| 5,748,075 | A | 5/1998 | Dirmeyer et al. |
| 6,057,660 | A | 5/2000 | Meier et al. |

(Continued)

FOREIGN PATENT DOCUMENTS

| | | | |
|---|---|---|---|
| CN | 201731408 U | * | 2/2011 |
| CN | 104405272 B | | 1/2016 |

(Continued)

OTHER PUBLICATIONS

Benson, K. Blair., et al. Standard Handbook of Audio and Radio Engineering. McGraw-Hill, 2002, p. 1-10.*

(Continued)

*Primary Examiner* — Kile O Blair

(74) *Attorney, Agent, or Firm* — Frank Lollo; Eversheds Sutherland (US) LLP

(57) ABSTRACT

Method and apparatus are disclosed for responding to HVAC-induced vehicle microphone buffeting. An example disclosed vehicle includes a microphone, a speaker, and a buffeting detector. The example microphone is electrically coupled to an input of a voice-activated system. The example speaker is located on a front driver side of the vehicle. The example buffeting detector, when a button is activated, determines a buffeting factor of a signal captured by the microphone. Additionally, the example buffeting detector, in response to the buffeting factor satisfying a threshold, activates a relay to electrically couple the speaker to the input of the voice-activated system.

18 Claims, 5 Drawing Sheets

(56) References Cited

U.S. PATENT DOCUMENTS

| | | | | |
|---|---|---|---|---|
| 6,278,377 | B1 | 8/2001 | Deline | |
| 6,732,566 | B2 | 5/2004 | Roelleke et al. | |
| 6,889,189 | B2 * | 5/2005 | Boman | G10L 21/0208 704/270 |
| 7,016,836 | B1 | 3/2006 | Yoda | |
| 7,149,318 | B2 | 12/2006 | Bank et al. | |
| 7,475,587 | B2 | 1/2009 | Kithil | |
| 7,516,645 | B2 | 4/2009 | Kithil | |
| 7,697,698 | B2 | 4/2010 | Brown | |
| 7,772,839 | B2 | 8/2010 | Watson | |
| 7,853,026 | B2 | 12/2010 | DeLine et al. | |
| 8,068,942 | B2 | 11/2011 | Breed | |
| 8,077,022 | B2 | 12/2011 | Baruco et al. | |
| 8,165,875 | B2 | 4/2012 | Hetherington et al. | |
| 8,285,545 | B2 | 11/2012 | Lee et al. | |
| 8,447,044 | B2 | 5/2013 | Nongpiur et al. | |
| 8,515,095 | B2 * | 8/2013 | Bard | G06F 1/206 381/94.1 |
| 8,538,749 | B2 | 9/2013 | Visser | |
| 8,682,005 | B2 | 3/2014 | Watson et al. | |
| 8,724,832 | B2 | 5/2014 | Stephanou et al. | |
| 8,849,656 | B2 | 9/2014 | Schmidt et al. | |
| 8,996,383 | B2 | 3/2015 | Rodemer | |
| 9,014,392 | B2 | 4/2015 | Sato et al. | |
| 9,020,690 | B2 | 4/2015 | McKown et al. | |
| 9,117,318 | B2 | 8/2015 | Ricci | |
| 9,124,219 | B2 * | 9/2015 | Thormundsson | H03F 1/26 |
| 9,154,893 | B1 | 10/2015 | Breed | |
| 9,218,698 | B2 | 12/2015 | Ricci | |
| 9,263,040 | B2 | 2/2016 | Tzirkel-Hancock et al. | |
| 9,317,983 | B2 | 4/2016 | Ricci | |
| 9,330,684 | B1 | 5/2016 | Kirsch | |
| 9,418,674 | B2 | 8/2016 | Tzirkel-Hancock et al. | |
| 9,469,247 | B2 | 10/2016 | Juneja et al. | |
| 9,539,984 | B2 | 1/2017 | Dias | |
| 9,665,873 | B2 | 5/2017 | Ackland | |
| 9,697,355 | B1 | 7/2017 | Park | |
| 9,870,697 | B2 | 1/2018 | Frew | |
| 2003/0209893 | A1 | 11/2003 | Breed | |
| 2004/0246607 | A1 | 12/2004 | Watson | |
| 2004/0260547 | A1 | 12/2004 | Cohen | |
| 2005/0071159 | A1 | 3/2005 | Boman et al. | |
| 2005/0074131 | A1 | 4/2005 | McCall et al. | |
| 2005/0109075 | A1 | 5/2005 | Kithil | |
| 2006/0184361 | A1 | 8/2006 | Lieb | |
| 2007/0005206 | A1 | 1/2007 | Zhang | |
| 2007/0086624 | A1 | 4/2007 | Breed | |
| 2007/0104026 | A1 * | 5/2007 | Rubin | G01W 1/10 367/13 |
| 2007/0277622 | A1 | 12/2007 | Kithil | |
| 2008/0040005 | A1 | 2/2008 | Breed | |
| 2008/0129475 | A1 | 6/2008 | Breed | |
| 2008/0175405 | A1 | 7/2008 | Couvillon | |
| 2008/0226098 | A1 | 9/2008 | Haulick | |
| 2008/0273711 | A1 | 11/2008 | Broussard et al. | |
| 2009/0115635 | A1 | 5/2009 | Berger | |
| 2009/0116661 | A1 | 5/2009 | Hetherington | |
| 2009/0125311 | A1 | 5/2009 | Haulick et al. | |
| 2009/0164147 | A1 | 6/2009 | Kithil | |
| 2009/0216526 | A1 | 8/2009 | Schmidt | |
| 2010/0239101 | A1 | 9/2010 | Okamura | |
| 2012/0140946 | A1 | 6/2012 | Yen | |
| 2012/0191447 | A1 | 7/2012 | Joshi | |
| 2012/0299718 | A1 | 11/2012 | Yoshino | |
| 2013/0053990 | A1 | 2/2013 | Ackland | |
| 2013/0188794 | A1 | 7/2013 | Kawamata | |
| 2013/0211828 | A1 | 8/2013 | Gratke | |
| 2013/0308784 | A1 * | 11/2013 | Dickins | H04R 3/005 381/56 |
| 2014/0294189 | A1 | 10/2014 | Pan | |
| 2014/0306826 | A1 | 10/2014 | Ricci | |
| 2015/0117155 | A1 | 4/2015 | Jang et al. | |
| 2015/0139428 | A1 * | 5/2015 | Reining | H04R 3/007 381/55 |
| 2015/0156587 | A1 | 6/2015 | Herbig et al. | |
| 2015/0239320 | A1 | 8/2015 | Eisenhour et al. | |
| 2015/0365743 | A1 | 12/2015 | Koningsberg et al. | |
| 2016/0019904 | A1 | 1/2016 | Charette | |
| 2016/0119890 | A1 | 1/2016 | Amman et al. | |
| 2016/0188285 | A1 | 6/2016 | Luk | |
| 2016/0217689 | A1 | 7/2016 | Young et al. | |
| 2016/0267908 | A1 | 9/2016 | Borjeson | |
| 2016/0299011 | A1 | 10/2016 | Ihle | |
| 2016/0320840 | A1 | 11/2016 | Hwang | |
| 2016/0355125 | A1 | 12/2016 | Herbert | |
| 2017/0018127 | A1 | 1/2017 | Yang et al. | |
| 2017/0088072 | A1 | 3/2017 | Curtis | |
| 2017/0118556 | A1 * | 4/2017 | Macours | H04R 3/005 |
| 2017/0171679 | A1 | 6/2017 | Isberg | |
| 2017/0345270 | A1 | 11/2017 | Singh | |
| 2018/0113673 | A1 | 4/2018 | Sheynblat | |
| 2018/0249250 | A1 | 8/2018 | Pate | |
| 2018/0336000 | A1 | 11/2018 | Vaughn | |

FOREIGN PATENT DOCUMENTS

| | | | |
|---|---|---|---|
| CN | 103770736 | | 12/2016 |
| CN | 106341755 | A1 | 1/2017 |
| DE | 10164509 | A1 | 7/2003 |
| DE | 10254684 | A1 | 6/2004 |
| DE | 102009046132 | A1 | 5/2011 |
| DE | 102011003730 | A1 | 7/2011 |
| EP | 1078818 | A2 | 2/2001 |
| FR | 2825882 | A1 | 12/2002 |
| JP | 3802897 | B2 | 5/2006 |
| JP | 2010000963 | A | 1/2010 |
| KR | 150554 | B1 | 6/1998 |
| KR | 101018783 | B1 | 3/2011 |
| WO | WO 98/047109 | A1 | 10/1998 |
| WO | WO 2013/90007 | A1 | 6/2013 |

OTHER PUBLICATIONS

Search Report dated Apr. 3, 2018 for Great Britain Patent Application No. GB 1716042.5 (3 Pages).

Christian Bolzmacher et al., Transforming Car Glass Into Microphones Using Piezoelectric Transducers, Microsystem Technologies, Jul. 2016, vol. 22, Issue 7, 3 pages.

Piezo Acoustics: Turning, Windows into Invisible Speakers and Helping James Bond Keep Secrets, 4 pages.

Karen M., Stickable Sound Pads Turn Any Surface Into a Speaker, Jul. 30, 2008,4 pages.

Ruotsalainen et al., Wireless system for the continuous observation of whole-body vibration in heavy machinery, 2013, IEEE, p. 26-32 (Year: 2013).

Bruel et al., Measuring Vibration, 1982, Internet, p. 1-40 (Year: 1982).

Hafizi et al., Modal properties investigation of car body-in-white with attached windscreen and rear screen, 2019, Internet, pg. (Year: 2019).

* cited by examiner

RESPONDING TO HVAC-INDUCED VEHICLE MICROPHONE BUFFETING

TECHNICAL FIELD

The present disclosure generally relates to vehicle hands-free communication and, more specifically, responding to HVAC-induced vehicle microphone buffeting.

BACKGROUND

Increasingly, vehicles are manufactured with hands-free communication systems. These hands-free communication systems reduce driver distraction by routing calls to and from a connected phone through a microphone and the sound system of the vehicle. The driver uses control on the steering wheel to interact with the hands-free communication system.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are disclosed for responding to HVAC-induced vehicle microphone buffeting. An example disclosed vehicle includes a microphone, a speaker, and a buffeting detector. The example microphone is electrically coupled to an input of a voice-activated system. The example speaker is located on a front driver side of the vehicle. The example buffeting detector, when a button is activated, determines a buffeting factor of a signal captured by the microphone. Additionally, the example buffeting detector, in response to the buffeting factor satisfying a threshold, activates a relay to electrically couple the speaker to the input of the voice-activated system.

An example method to detect buffeting of a microphone electrically coupled to an input of a voice-activated system of a vehicle includes, when a button is activated, determining a buffeting factor of a signal captured by the microphone. The example method also includes, in response to the buffeting factor satisfying a threshold, activating a relay to electrically couple a speaker to the input of the voice-activated system, the speaker located on a front driver side of the vehicle.

A tangible computer readable medium comprising instructions that, when executed, cause a vehicle to when a button is activated, determine a buffeting factor of a signal captured by a microphone communicatively coupled to an input of a voice-activated system. Additionally, the instructions also cause the vehicle to, in response to the buffeting factor satisfying a threshold, activate a relay to electrically couple a speaker to the input of the voice-activated system, the speaker located on a front driver side of the vehicle.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
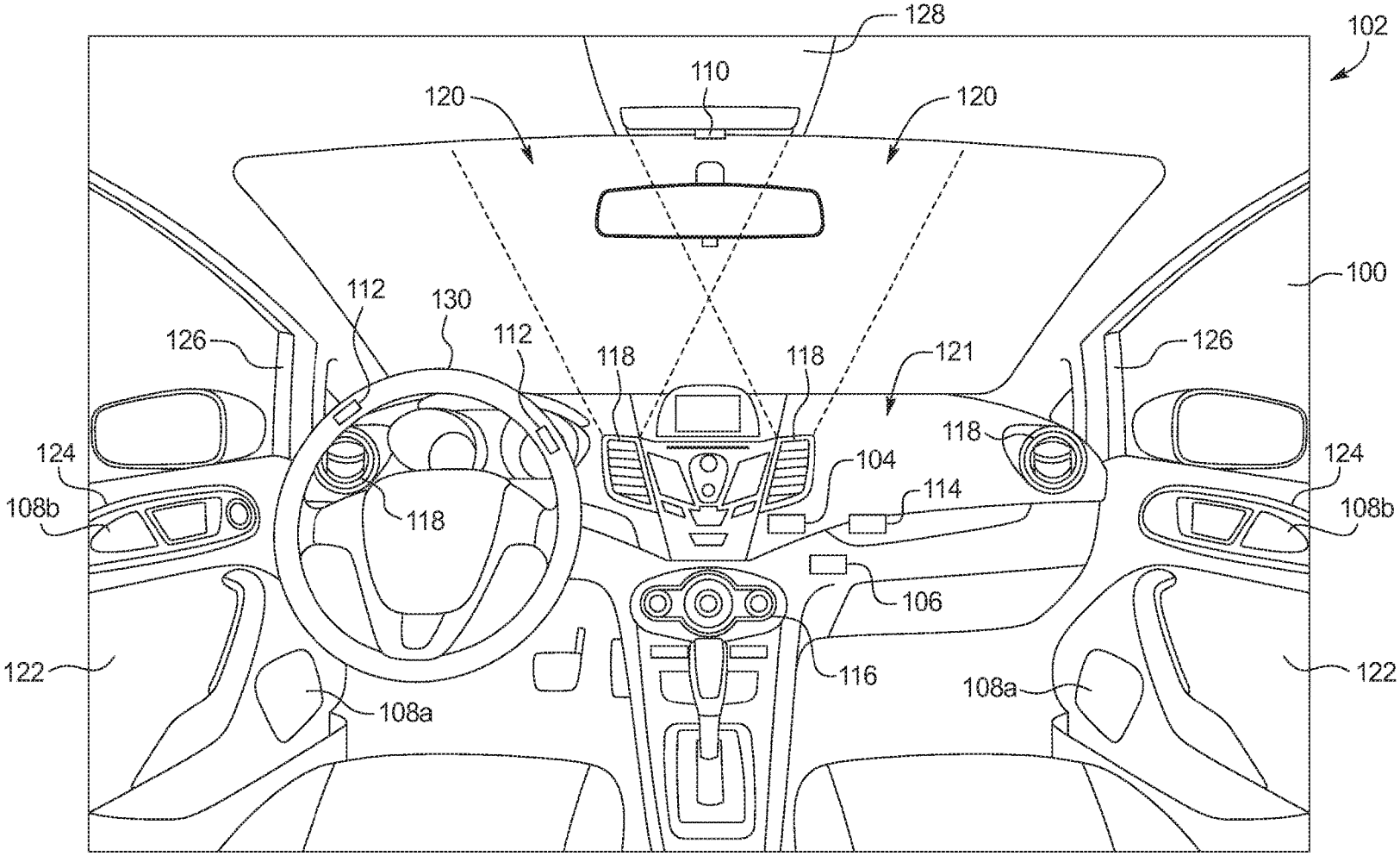
FIG. 1 illustrates an interior of a vehicle operating in accordance with the teachings of this disclosure.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

Voice-activated systems use the input of a microphone of a vehicle. The voice-activated systems include hands free calling systems, voice recognition systems, in car communication systems and/or other systems that process the signal from the microphone. For examples, hands free calling systems establish a connection with a mobile device (e.g., smart phones, smart watches, tablets, etc.) so that the microphone is used as an audio input for the mobile device and speakers of the vehicle are used as the audio output of the device. As another example, mobile devices with digital personal assistants (such as Siri® from Apple®, Alexa® from Amazon®, Cortana® from Microsoft®, etc.) use voice recognition to enhance control of the hands free calling system, control the mobile device, and/or retrieve information (e.g., from memory of the mobile device, from the Internet, etc.), etc. Because of placement of the microphone (e.g., in an overhead center console, etc.), when the heating, ventilation and air conditioning (HVAC) system is in operation, the vents may be positioned such that the air is directed at the microphone. This causes a "buffeting" noise as the air flow deflects and distorts the diaphragm of the microphone and reduces the ability of the connected digital personal assistant to interpret voice commands.

As disclosed below, the voice-activated system monitors the audio input of the microphone of the vehicle. The system evaluates the audio input to determine a buffeting factor. The system determines that the HVAC system is causing buffeting of the microphone when the buffeting factor satisfies (e.g., is greater than or equal to) a corresponding threshold. When the buffeting factor satisfies the threshold, the system switches to capture audio input from one of the speakers of the vehicle. The buffeting factor is measured by (a) determining the low frequency (e.g., 0 Hz to 1000 Hz, 20 Hz to 500 Hz, etc.) content of the signal captured by the microphone and/or (b) determining the fluctuation strength of the signal captured by the microphone. In some examples, the level of the threshold is based on a blower speed of the HVAC system. To change the audio input, the voice-activated system activates a relay that disconnects the vehicle microphone and connects one of the speakers of the vehicle (e.g., the driver side tweeter, etc.) to the input of the voice-activated system. This causes the speaker to act as a microphone. In such a manner, the voice-activated system receives voice input from the driver even when the HVAC system is buffeting the microphone.

FIG. 1 illustrates an interior 100 of a vehicle 102 operating in accordance with the teachings of this disclosure. The vehicle 102 may be a standard gasoline powered vehicle, a hybrid vehicle, an electric vehicle, a fuel cell vehicle, and/or any other mobility implement type of vehicle. The vehicle 102 includes parts related to mobility, such as a powertrain with an engine, a transmission, a suspension, a driveshaft, and/or wheels, etc. The vehicle 102 may be non-autonomous, semi-autonomous (e.g., some routine motive functions controlled by the vehicle 102), or autonomous (e.g., motive functions are controlled by the vehicle 102 without direct driver input). In the illustrated example the vehicle 102 includes an infotainment head unit 104, an HVAC system 106, speakers 108*a* and 108*b*, a microphone 110, a push-to-talk (PTT) button 112, and a buffeting detector 114.

The infotainment head unit 104 provides an interface between the vehicle 102 and a user (e.g., the driver). The infotainment head unit 104 includes digital and/or analog interfaces (e.g., input devices and output devices) to receive input from the user(s) and display information. The input devices may include, for example, a control knob, an instrument panel, a digital camera for image capture and/or visual command recognition, a touch screen, an audio input device (e.g., cabin microphone), buttons, or a touchpad. The output devices may include instrument cluster outputs (e.g., dials, lighting devices), actuators, a heads-up display, a center console display (e.g., a liquid crystal display ("LCD"), an organic light emitting diode ("OLED") display, a flat panel display, a solid state display, etc.), and/or speakers. In the illustrated example, the infotainment head unit 104 includes hardware (e.g., a processor or controller, memory, storage, etc.) and software (e.g., an operating system, etc.) for an infotainment system (such as SYNC® and MyFord Touch® by Ford®, Entune® by Toyota®, IntelliLink® by GMC®, etc.). Additionally, the infotainment head unit 104 displays the infotainment system on, for example, the center console display. Additionally, the infotainment head unit 104 provides controls 116 for the HVAC system 106. In some examples, the controls are physical (e.g., buttons, knobs, switches, etc.). Alternatively or additionally, in some examples, the controls 116 are digital control provided by the infotainment system interface through a touch screen of the center console display.

The HVAC system 106 provides hot or cold air to the interior 100 of vehicle 102 through vents 118. The vents 118 are adjustable to direct the flow of air (represented by dashed lines 120) to different parts of the interior 100 of the vehicle 102. In the illustrated example, the flow of air is directed upwards. The controls for the HVAC system 106 facilitate setting a temperature, a blower speed, and a location (e.g., to which vents 118 the flow of air should be directed). The blower speed setting changes the force of the flow of air output by a blower of the HVAC system 106. The HVAC system 106 broadcasts the blower speed setting via a vehicle data bus (e.g., the vehicle data bus 406 of FIG. 4 below).

In the illustrated example, the speakers 108*a* and 108*b* include midrange speakers 108*a* and tweeters 108*b*. Alternatively, in some examples, the speakers 108*a* and 108*b* are full range speakers. The example speakers 108*a* and 108*b* are built into the doors 122 of the vehicle 102. Additionally or alternatively, in some examples, the speakers 108*a* and 108*b* are built into a dashboard 121 of the vehicle 102. In the illustrated example, the midrange speakers 108*a* are located on a lower portion of the doors 122 and the tweeters 108*b* are located on an interior door handle assembly 124. Alternatively, in some examples, the tweeters 108*b* are incorporated into the A-pillar 126 of the vehicle 102.

The microphone 110 is directed at the driver of the vehicle 102 to capture the voice of the driver. In some examples, the microphone is a cardioid-directionality microphone. In the illustrated example, the microphone 110 is incorporated into an overhead center console 128. Alternatively, in some examples, the microphone is incorporated into the dashboard 121 or a steering wheel 130. When the air flow from the vents 118 of the HVAC system 106 is directed at the microphone 110, the air flow deflects and distorts the diaphragm of the microphone 110, decreasing the signal-to-noise ratio of the voice captured from the driver.

The PTT button 112 activates the voice-activated system when pressed by the driver. In the illustrated example, the PTT button 112 is incorporated into the steering wheel 130. In some examples, the vehicle 102 may include several PTT buttons 112 to accommodate different hand positions on the steering wheel 130. Alternatively or additionally, in some examples, the buffeting detector 114 uses automated or semi-automated method to initiate processing of the microphone signal to activate the voice-activated system. For example, the buffeting detector 114 may activate the voice-activated system based on detecting when a root-mean-squared value (RMS) of signal captured by the microphone 110 is above a threshold in a certain frequency range (e.g. 300 Hz to 3400 Hz, etc.). As used here herein, an "activation event" refers to initiating processing of the microphone signal to activate the voice-activated system based on (a) the PTT button 112 or (b) the automated or semi-automated method.

The buffeting detector 114 (a) detects when the flow of air from the vents 118 is directed at the microphone 110, and (b) when buffeting is detected, connects one of the speakers 108*a* and 108*b* to the voice-activated system. The buffeting detector 114 analyzes the signal captured by the microphone 110 when the PTT button 112 is activated to determine a buffeting factor. The buffeting detector 114 measures the buffeting factor by (a) determining the low frequency (e.g., 0 Hz to 1000 Hz, 20 Hz to 500 Hz, etc.) content of the signal captured by the microphone 110 (sometimes referred to as the "LF buffeting factor") and/or (b) determining the fluctuation strength of the signal captured by the microphone 110 sometimes referred to as the "fluctuation buffeting factor"). The buffeting detector 114 compares the buffeting factor to a threshold. In some examples, the buffeting detector 114 measures and compares more than one buffeting factor to reduce the change of false determinations (e.g., via a voting algorithm, etc.). The threshold is based on the type of buffeting factor being measured. In some examples, the buffeting detector 114 also adjusts the level of the threshold based on the blower speed. When the buffeting factor satisfies (e.g., is greater than or equal to) the threshold, the buffeting detector 114 activates a relay (e.g., the relay 404 of FIG. 4 below) to switch the input to the voice-activated system from the microphone 110 to one of the speakers 108*a* and 108*b*. In some examples, the buffeting detector 114 switches the input to the tweeter 108*b* located on front driver's side of the vehicle 102.

Figure 2:
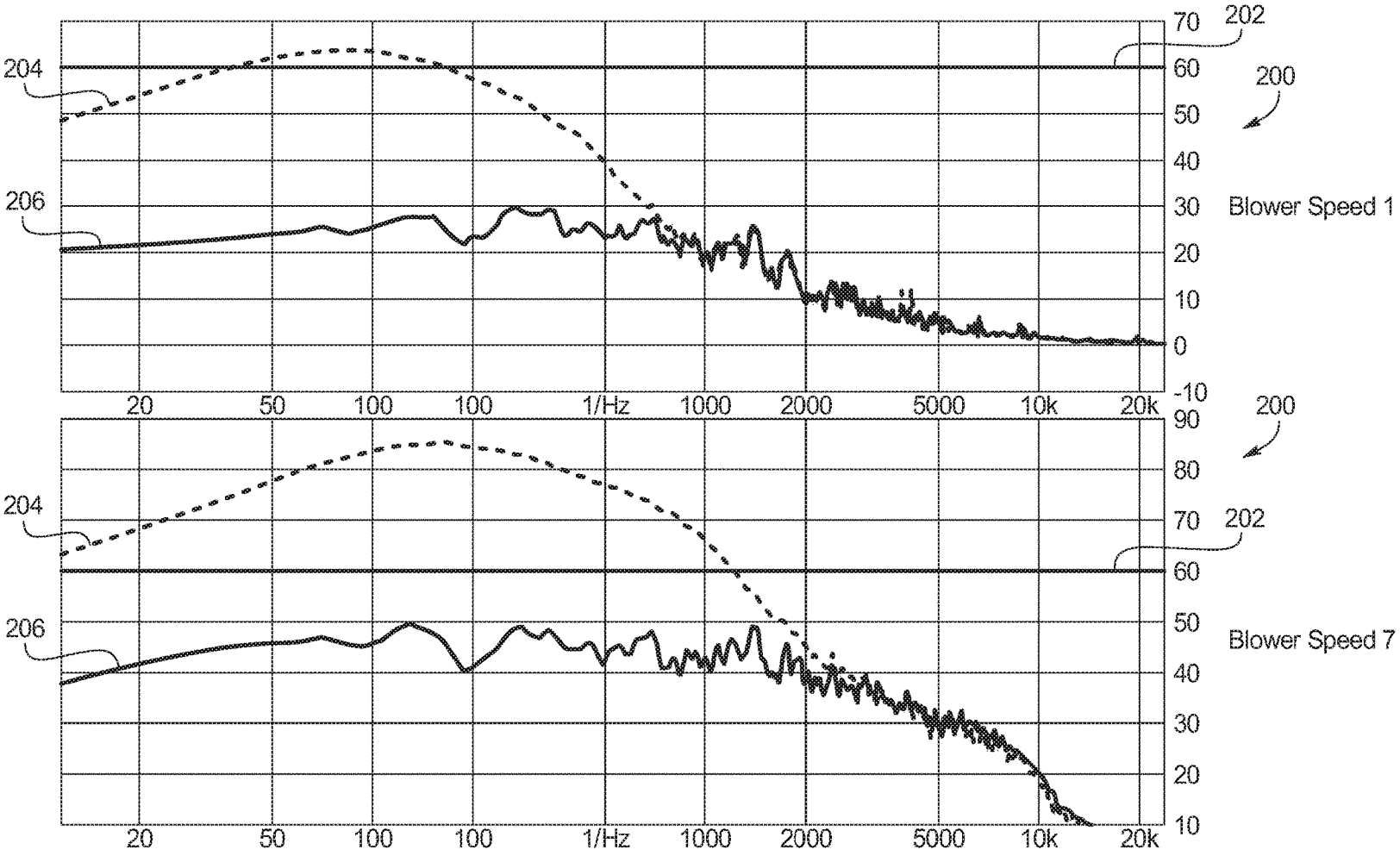
FIGS. 2 and 3 are graphs depicting detection of HVAC-induced buffeting on the microphone of the vehicle of FIG. 1.

FIG. 2 is a graph 200 depicting detection of HVAC-induced buffeting on the microphone 110 of the vehicle 102 of FIG. 1. In the illustrated example, the buffeting detector 114 measures the LF buffeting factor. As the airflow from the HVAC system 106 impinges on the microphone 110, the air pressure causes the diaphragm of the microphone 110 to displace in a set of non-periodic measurable frequencies. The pressure oscillations measured in the signals from the microphone 110 appear in the frequency domain as low frequency content. The buffeting detector 114 performs a fast Fourier transform (FFT) on the signal to determine the low frequency content. For example, the transformed signal may show elevated spectral content from 0-1000 Hz when the diaphragm of the microphone 110 is undergoing the buffeting. The buffeting detector 114 calculates a root-mean-squared (RMS) value (e.g., in decibels (dB)) calculated across the frequency range of interest (e.g., 0-1000 Hz). The calculated RMS value is compared to a LF threshold 202. The LF threshold 202 is based on the RMS value measured when the vents 118 are pointed at the microphone 110. In some examples, a threshold RMS value is determined for each blower speed. The buffeting detector 114 receives the blower speed from the HVAC system 106 via the vehicle data bus (e.g., the vehicle data bus 406 of FIG. 4 below). The buffeting detector 114 measures the LF buffeting factor when the PTT button 112 is activated. The illustrated example depicts a signal 204 with buffeting and a signal 206 without buffeting.

Figure 3:
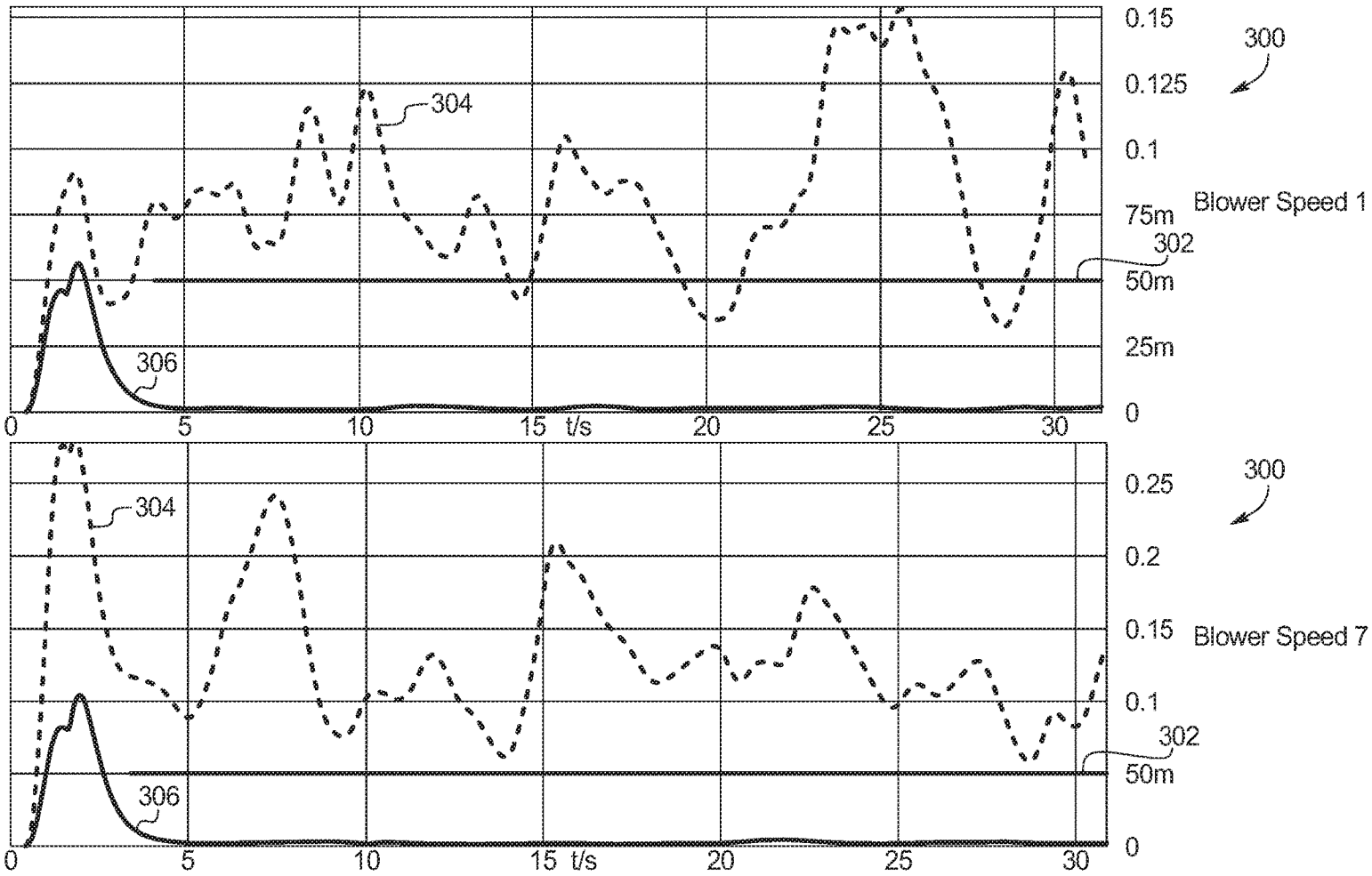

FIG. 3 is a graph 300 depicting detection of HVAC-induced buffeting on the microphone 110 of the vehicle 102 of FIG. 1. The graph 300 depicts modulated signals. The modulated signal includes a component caused by the air-flow buffeting on the microphone (which creates a hearing sensation known as fluctuation strength). These fluctuations occur below 20 Hz. To measure the fluctuations, the buffeting detector 114 (a) applies a low-pass filter (e.g., at 20 Hz) and (b) calculates a dB or an A-weighted decibel (dBA) level of the sound as a function of time. The fluctuation threshold 302 is based on a long term average of the fluctuation of the signal over time. In some examples, the fluctuation is measured at a time delay (e.g. five seconds, etc.) after the PTT button 112 is activated. Examples of calculating the fluctuation value of a signal (e.g., the signal captured by the microphone 110) are described by E. Zwicker and H. Fastl in "Psychoacoustics Facts and Models Second Updated Edition" January 1999, which is incorporated herein by reference in its entirety. The illustrated example depicts a signal 304 with buffeting and a signal 306 without buffeting.

Figure 4:
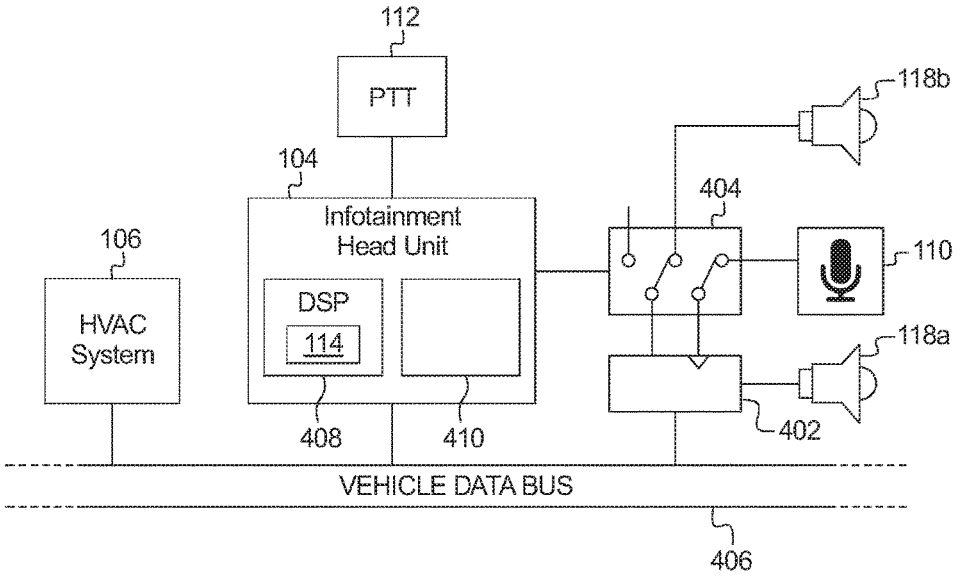
FIG. 4 is a block diagram of electronic components of the vehicle of FIG. 1.

FIG. 4 is a block diagram of electronic components 400 of the vehicle 102 of FIG. 1. In the illustrated example, the electronic components 400 include the infotainment head unit 104, the HVAC system 106, the speakers 108*a* and 108*b*, the microphone 110, the PTT button(s) 112, a voice-activated system 402, a relay 404, and a vehicle data bus 406.

In the illustrated example, the infotainment head unit 104 includes a processor or controller 408 and memory 410. In some examples, the infotainment head unit 104 is structured to include buffeting detector 114. Alternatively, in some examples, the buffeting detector 114 may be incorporated into another electronic control unit (ECU) (e.g., the voice-activated system 402) with its own processor and memory. The processor or controller 408 may be any suitable processing device or set of processing devices such as, but not limited to: a microprocessor, a digital signal processor, a microcontroller-based platform, a suitable integrated circuit, one or more field programmable gate arrays (FPGAs), and/or one or more application-specific integrated circuits (ASICs). The memory 410 may be volatile memory (e.g., RAM, which can include non-volatile RAM, magnetic RAM, ferroelectric RAM, and any other suitable forms); non-volatile memory (e.g., disk memory, FLASH memory, EPROMs, EEPROMs, memristor-based non-volatile solid-state memory, etc.), unalterable memory (e.g., EPROMs), read-only memory, and/or high-capacity storage devices (e.g., hard drives, solid state drives, etc). In some examples, the memory 410 includes multiple kinds of memory, particularly volatile memory and non-volatile memory.

The memory 410 is computer readable media on which one or more sets of instructions, such as the software for operating the methods of the present disclosure can be embedded. The instructions may embody one or more of the methods or logic as described herein. In a particular embodiment, the instructions may reside completely, or at least partially, within any one or more of the memory 410, the computer readable medium, and/or within the processor 408 during execution of the instructions.

The terms "non-transitory computer-readable medium" and "computer-readable medium" should be understood to include a single medium or multiple media, such as a centralized or distributed database, and/or associated caches and servers that store one or more sets of instructions. The terms "non-transitory computer-readable medium" and "computer-readable medium" also include any tangible medium that is capable of storing, encoding or carrying a set of instructions for execution by a processor or that cause a system to perform any one or more of the methods or operations disclosed herein. As used herein, the term "computer readable medium" is expressly defined to include any type of computer readable storage device and/or storage disk and to exclude propagating signals.

The voice-activated system 402 communicatively couples to a cellular-enabled mobile device (e.g., a phone, a smart watch, a tablet, etc.) via a short range wireless module (e.g., Bluetooth®, Bluetooth® Low energy, etc.). The voice-activated system includes a hand-free calling system, a voice recognition system, and/or digital assistant system, etc. When the voice-activated system 402 is communicatively coupled to the mobile device, the audio input and output of the mobile device is routed to the voice-activated system 402. When the microphone is not being buffeted by the airflow of the HVAC system 106, the voice-activated system 402 uses the microphone 110 as the input to the mobile device and the speakers 108*a* and 108*b* as the output of the mobile device.

The relay 404 is coupled with one of the speakers 108*a* and 108*b*, the microphone 110, and the buffeting detector 114. When not activated by the buffeting detector 114, the relay 404 electrically couples the microphone 110 with the input of the voice-activated system 402. When activated by the buffeting detector 114, the relay 404 electrically couples one of the speakers 108*a* and 108*b* (e.g., the tweeter 108*b* of the front driver's side) to the input of the voice-activated system 402 instead of the microphone 110. In some examples, the relay 404 is a solid state relay. Alternatively, in some examples, the relay 404 is a transistor-based relay.

The vehicle data bus 406 communicatively couples the infotainment head unit 104 and the HVAC system 106. In some examples, the vehicle data bus 406 includes one or more data buses. The vehicle data bus 406 may be implemented in accordance with a controller area network (CAN) bus protocol as defined by International Standards Organization (ISO) 11898-1, a Media Oriented Systems Transport (MOST) bus protocol, a CAN flexible data (CAN-FD) bus protocol (ISO 11898-7) and/a K-line bus protocol (ISO 9141 and ISO 14230-1), and/or an Ethernet™ bus protocol IEEE 802.3 (2002 onwards), etc.

Figure 5:
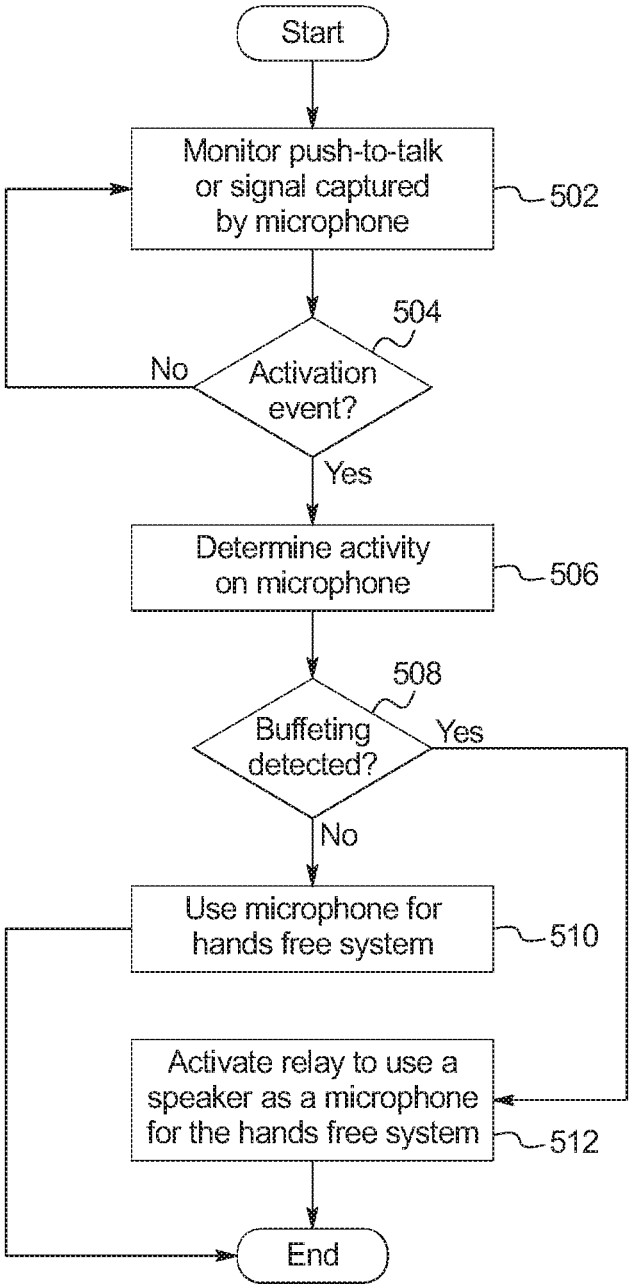
FIG. 5 is a flowchart of a method to detect and reducing HVAC-induced vehicle microphone buffeting that may be implemented by the electronic components of FIG. 4.

FIG. 5 is a flowchart of a method to detect and reducing HVAC-induced microphone 110 buffeting that may be implemented by the electronic components 400 of FIG. 4.

Initially, at block 502, the buffeting detector 114 monitors the PTT button(s) 112 and/or the signal captured by the microphone 110. At block 504, the buffeting detector 114 determines whether an activation event has occurred. For example, the activation event may occur when the PTT button 112 has been activated. As another example, the activation event may occur when and RMS value of the signal captured by the microphone 110 is greater than a threshold value in a frequency range of interest (e.g., 300 Hz to 3400 HZ, etc.). If the activation event has occurred, the method continues to block 506. Otherwise, if the activation event has not occurred, the method returns to block 502.

At block 506, the buffeting detector 114 determines the buffeting factor on the signal captured by the microphone 110. The buffeting detector 114 determines the buffeting factor based on the LF buffeting factor (as disclosed above in FIG. 2) and/or the fluctuation buffeting factor (as disclosed above in FIG. 3 At block 508, the buffeting detector 114 determines whether buffeting is detected. The buffeting detector 114 determines that buffeting is detected when the buffeting factor(s) calculated at block 506 satisfy (e.g., are greater than or equal to) a threshold. If the buffeting is detected, the method continues at block 510. Otherwise, if buffeting is not detected, the method continues at block 512. At block 510, the buffeting detector 114 activates the relay 404 to electrically couple one of the speakers 108*a* and 108*b* to the input of the voice-activated system 402. At block 512, the buffeting detector 114 does not activate the relay so that the microphone 110 is electrically coupled to the input of the voice-activated system 402.

The flowchart of FIG. 5 is representative of machine readable instructions stored in memory (such as the memory 410 of FIG. 4) that comprise one or more programs that, when executed by a processor (such as the processor 408 of FIG. 6), cause the vehicle 102 to implement the example buffeting detector 114 of FIGS. 1 and 4. Further, although the example program(s) is/are described with reference to the flowchart illustrated in FIG. 5, many other methods of implementing the example buffeting detector 114 may alternatively be used. For example, the order of execution of the blocks may be changed, and/or some of the blocks described may be changed, eliminated, or combined In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. A vehicle comprising:

a microphone;

a speaker; and a buffeting detector to:

in response to an activation event:

generate a first buffeting factor by performing a fast Fourier transform on a signal captured on the microphone to generate a frequency domain signal, and calculating a root-mean-squared value of the frequency domain signal over a frequency range;

generate a second buffeting factor based on a fluctuation strength of the signal; and in response to the first buffeting factor satisfying a first threshold and the second buffeting factor satisfying a second threshold, electrically couple the speaker to an input of a voice-activated system, wherein the second threshold is an average of a plurality of fluctuation strengths of the signal over a first predetermined period.

2. The vehicle of claim 1, wherein the speaker is a tweeter.

3. The vehicle of claim 1, wherein the speaker is integrated into an interior door handle assembly of the front driver side of the vehicle.

4. The vehicle of claim 1, wherein the activation event is activation of a push-to-talk button, and wherein the buffeting detector is to monitor the signal captured by the microphone when the push-to-talk button is activated, and not monitor the signal captured by the microphone when the push-to-talk button is not activated.

5. The vehicle of claim 1, wherein when the speaker is coupled to the input of the voice-activated system, the relay uncouples the microphone from the input of the voice-activated system.

6. The vehicle of claim 1, wherein to determine the second buffeting factor, the buffeting detector is to:

apply a low-pass filter to the signal captured on the microphone, the low-pass filter having a cutoff frequency at a frequency of interest; and calculate a decibel level of the filtered signal as a function of time.

7. The vehicle of claim 6, wherein the frequency of interest is 20 Hz.

8. The vehicle of claim 1, wherein the activation event is when a root-mean-squared value of a signal captured by the microphone in a frequency range between 300 Hz to 3400 Hz is greater than a threshold.

9. The vehicle of claim 1, wherein the microphone is: (1) positioned on a roof of the vehicle; and (2) positioned directly above a front window of the vehicle.

10. The vehicle of claim 1, wherein the buffeting detector electrically couples the speaker to the input only when: (1) the first buffeting factor satisfies the first threshold; and (2) the second buffeting factor satisfies the second threshold.

11. The vehicle of claim 1, further comprising a push-to-talk button, wherein the buffeting detector generates the second buffering factor in response to a second predetermined period elapsing subsequent to an actuation of the push-to-talk button.

12. A method to detect buffeting of a microphone electrically coupled to a voice-activated system of a vehicle, the method comprising:

when a button is activated:

generating a first buffeting factor by performing a fast Fourier transform on the signal captured on the microphone to generate a frequency domain signal, and calculating a root-mean-squared value the frequency domain signal between a first frequency of interest and a second frequency of interest;

generating a second buffeting factor based on a fluctuation strength of the signal; and in response to the first buffeting factor satisfying a first threshold and the second buffeting factor satisfying a second threshold, activating a relay to electrically couple a speaker in a door handle assembly to the input of the voice-activated system, wherein the second threshold is an average of a plurality of fluctuation strengths of the signal over a first predetermined period.

13. The method of claim 12, wherein the speaker is a tweeter.

14. The method of claim 12, including monitoring the signal captured by the microphone when the button is activated, and not monitoring the signal captured by the microphone when the button is not activated.

15. The method of claim 12, wherein when the speaker is coupled to the input of the voice-activated system, the relay uncouples the microphone from the input of the voice-activated system.

16. The method of claim 12, wherein the first frequency of interest is 0 Hz, and the second frequency of interest is 1000 Hz.

17. The method of claim 12, wherein determining the second buffeting factor includes:

applying a low-pass filter to the signal captured on the microphone, the low-pass filter having a cutoff frequency at a frequency of interest; and calculating a decibel level of the filtered signal as a function of time.

18. The method of claim 17, wherein the frequency of interest is 20 Hz.

* * * * *